US006969226B2

(12) United States Patent
Raley

(10) Patent No.: US 6,969,226 B2
(45) Date of Patent: Nov. 29, 2005

(54) FRONT END LOADER BUCKET DISCHARGE FUNNEL AND DISTRIBUTOR

(76) Inventor: Thomas A. Raley, 45840 Jay Dee Ct., Lexington Park, MD (US) 20653

( * ) Notice: Subject to any disclaimer, the term of this patent is extended or adjusted under 35 U.S.C. 154(b) by 0 days.

(21) Appl. No.: 10/770,494

(22) Filed: Feb. 4, 2004

(65) Prior Publication Data

US 2005/0169739 A1 Aug. 4, 2005

(51) Int. Cl.[7] ..... E02F 3/407

(52) U.S. Cl. ..... 414/725; 37/403; 37/903; 222/460

(58) Field of Search ..... 414/724, 725, 414/722, 912; 37/444, 903, 403; 222/460

(56) References Cited

U.S. PATENT DOCUMENTS 2,590,352 A 3/1952 Sanner et al.
2,783,558 A 3/1957 Morgan
3,598,266 A 8/1971 Fisher
4,068,771 A 1/1978 Zimmerman
5,692,875 A * 12/1997 Boman ..... 414/725
6,085,447 A 7/2000 Rose
6,578,297 B1 * 6/2003 Forsberg ..... 37/444

* cited by examiner

*Primary Examiner*—Donald W. Underwood
(74) *Attorney, Agent, or Firm*—Richard C. Litman

(57) ABSTRACT

A discharge funnel and distributor chute for sand and gravel or other disperse material which is removably attachable to the bucket of a front end loader. Funnel engaging hooks are attached along the front edges of the sides of the bucket and spaced upward from the bucket floor. The funnel has a floor and vertical sidewalls forming an open rear bucket receiving portion for receiving the front lower portion of the bucket. This portion has a floor and sides with a hook engaging bar extending between upper ends of the funnel sides forming a rear opening. Angled bucket guide bars are located along the inner sides of opposite walls. The funnel has a converging funnel portion connected to the engaging portion. The converging portion opens into a discharge chute. The chute allows the discharge of disperse material to a specific location such as a basement floor under construction.

19 Claims, 5 Drawing Sheets

FRONT END LOADER BUCKET DISCHARGE FUNNEL AND DISTRIBUTOR

BACKGROUND OF THE INVENTION

1. Field of the Invention

The present invention relates to earth and gravel moving tractors. More particularly, the present invention is related to extensions for the front bucket of a front loading tractor having a disperse material funneling and distributing function.

2. Description of the Related Art

During construction of buildings such as houses and industrial buildings, it is necessary to provide gravel or other material to an area to be covered with concrete to form a level base for the concrete. In the case of basements, a front loading tractor cannot transport needed material to locations spaced away from the surrounding walls, so that it is necessary to employ wheelbarrows, requiring heavy labor and time to move the gravel or sand to the desired locations along the surface for spreading to form a level base for the concrete pour. It is known to provide various attachments to the front bucket of a front loader tractor (otherwise known as a front-end loader) to accomplish various functions such as extending the reach or capacity of the bucket, trench digging, or controlling the flow of materials from the front bucket during the dumping process. It would be desirable to provide an attachment which allows the delivery of gravel or similar materials to a location remote from the bucket during the spreading of a base for pouring concrete floors or equivalent operations.

U.S. Pat. No. 2,590,352, issued Mar. 25, 1952, to Sanner et al., describes a front load bucket having a ditch digging attachment.

U.S. Pat. No. 2,783,558, issued Mar. 5, 1957, to Morgan, describes a trenching attachment for excavating buckets.

U.S. Pat. No. 3,598,266, issued Aug. 10, 1971, describes a curved plate bucket extension allowing the control of the opening between the bucket and the plate and thus the rate of flow of material from the bucket.

U.S. Pat. No. 4,068,771, issued Jan. 17, 1978, to Zimmerman, describes a front loader bucket attachment consisting of a separate carrier bucket having a front dumping chute which is particularly useful for carrying and pouring concrete.

U.S. Pat. No. 6,085,447, issued Jul. 11, 2000, to Rose, describes a trenching tool attachment for a bucket of a front end loader.

None of the above inventions and patents, taken either singly or in combination, is seen to describe the instant invention as claimed. Thus, a front end loader bucket discharge funnel solving the aforementioned problems is desired.

SUMMARY OF THE INVENTION

The present invention is a discharge funnel and distributor chute for sand and gravel or other disperse material, which is removably attachable to the bucket of a front end loader. Funnel engaging hooks are attached along the front edges of the sides of the bucket and spaced upward from the bucket floor. The funnel has a floor and vertical sidewalls forming an open rear bucket receiving portion for receiving the front lower portion of the bucket and a converging portion. The bucket receiving portion has a floor and sides with a hook-engaging bar extending between upper ends of the funnel sides forming a rear opening for receiving the bucket.

Angled bucket guide bars are located along the inner sides of opposite walls. The funnel has a converging funnel portion connected to the engaging portion. The converging portion opens into a discharge chute of any desired length but is preferably of substantial length as compared with the length of the funnel. The discharge chute allows the discharge of disperse material to a desired location such as in a basement floor under construction.

The invention provides improved elements and arrangements thereof for the purposes described which is inexpensive, dependable and fully effective in accomplishing its intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a discharge funnel and distributor chute for sand and gravel or other disperse material, which is removably attachable to the bucket of a front end loader. Funnel engaging hooks are attached along the front edges of the sides of the bucket and spaced upward from the bucket floor. The funnel has a floor and vertical sidewalls forming an open rear bucket receiving portion for receiving the front lower portion of the bucket and a converging portion. The bucket receiving portion has a floor and sides with a hook-engaging bar extending between upper ends of the funnel sides forming a rear opening for receiving the bucket. Angled bucket guide bars are located along the inner sides of opposite walls. The funnel has a converging funnel portion connected to the engaging portion. The converging portion opens into a discharge chute of any desired length but is preferably of substantial length as compared with the length of the funnel. The discharge chute allows the discharge of disperse material to a desired location such as in a basement floor base of a house under construction.

Figure 1:
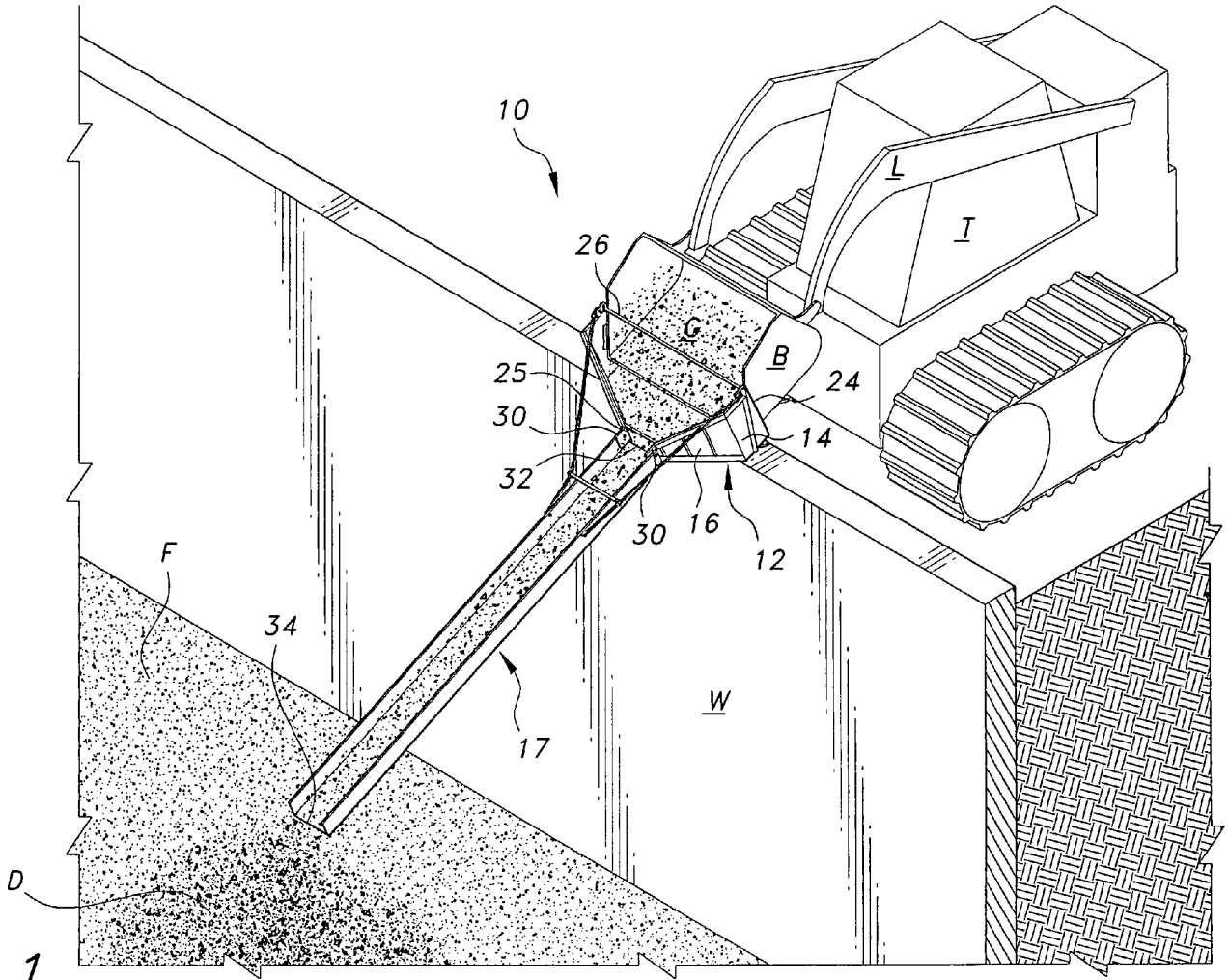
FIG. 1 is an environmental, perspective view of a front end loader bucket discharge funnel and distributor according to the present invention.

Referring to FIG. 1, there is shown a front loader bucket funnel and chute distributing system referred to generally by the element number 10. System 10 includes the funnel 12 as attached to bucket B mounted on lift arm L of tractor T. Funnel 12 has a bucket engaging portion 14 and a converging funnel portion 16 to which is attached a chute 17. Chute 17 extends from the converging funnel portion 16, carrying a disperse material such as gravel G from the bucket B via funnel 12 to a delivery location D in the basement floor base F. As is shown, the tractor T has been maneuvered near the wall W of the basement being constructed such that the gravel G is delivered to a desired location D in the gravel base of floor F. The tractor T may be maneuvered to other locations along wall W for delivery of gravel or sand to another location D on floor base F. Tractor T may be maneuvered closer to or further away from wall W to deliver gravel G to a position nearer the center of floor base F or the wall W as desired. The chute 17 may be chosen from several lengths to provide adequate reach to accomplish distribution of gravel G to necessary locations D for a variety of sizes of floor base F.

As shown, bucket B is inserted through bucket engaging opening 24 of funnel 12. Funnel 12 opens into chute 17 at funnel outlet 25. Hook receiving bar 26 extends across the upper span of opening 24 for engagement with bucket side hooks 20 (see FIG. 2). Chute 17 is attached to funnel 12 by attachment to opposed attachment plates 30 extending from funnel outlet 25 such that chute inlet end 32 provides continuous support for gravel G exiting funnel 12. Chute 17 is continuous to outlet end 34 where gravel G or other disperse material is delivered.

Figure 2:
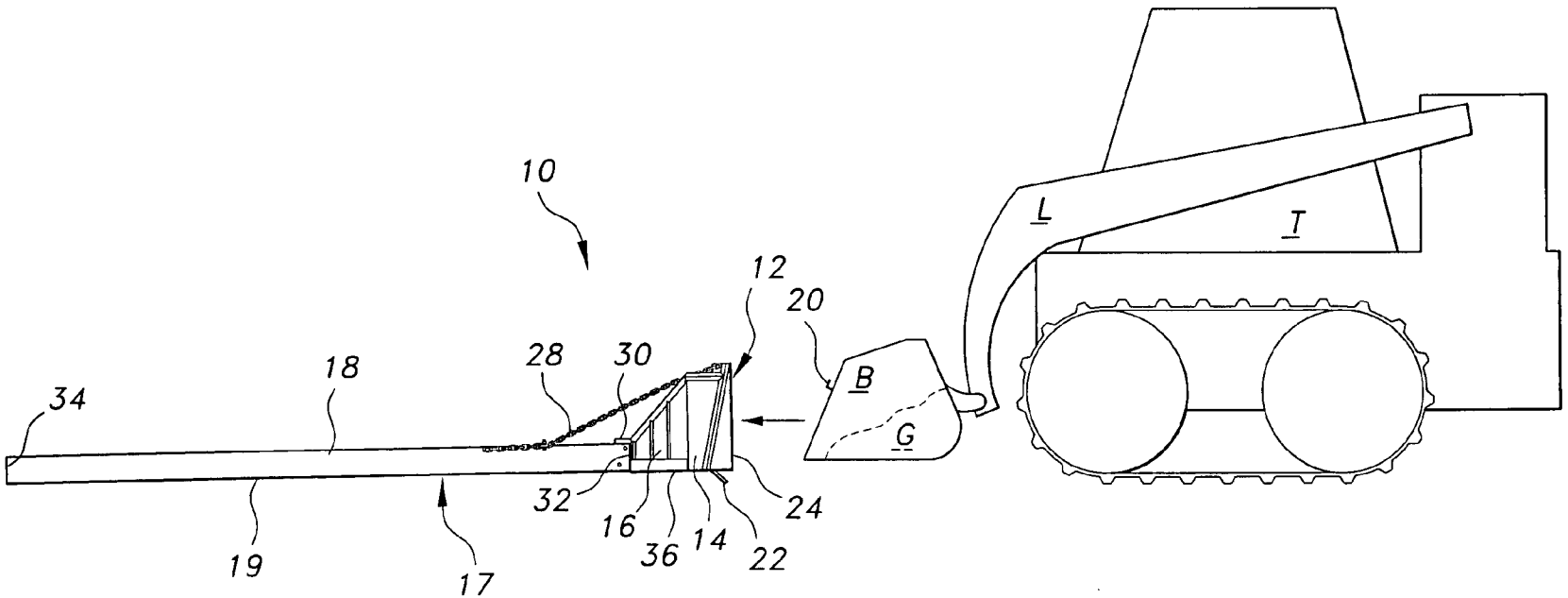
FIG. 2 is a side elevation view of a loader with the gravel-filled bucket lowered and spaced from the rear opening of the discharge funnel and distributor of FIG. 1 in a position to move forward to engage the funnel and distributor.
Figure 3:
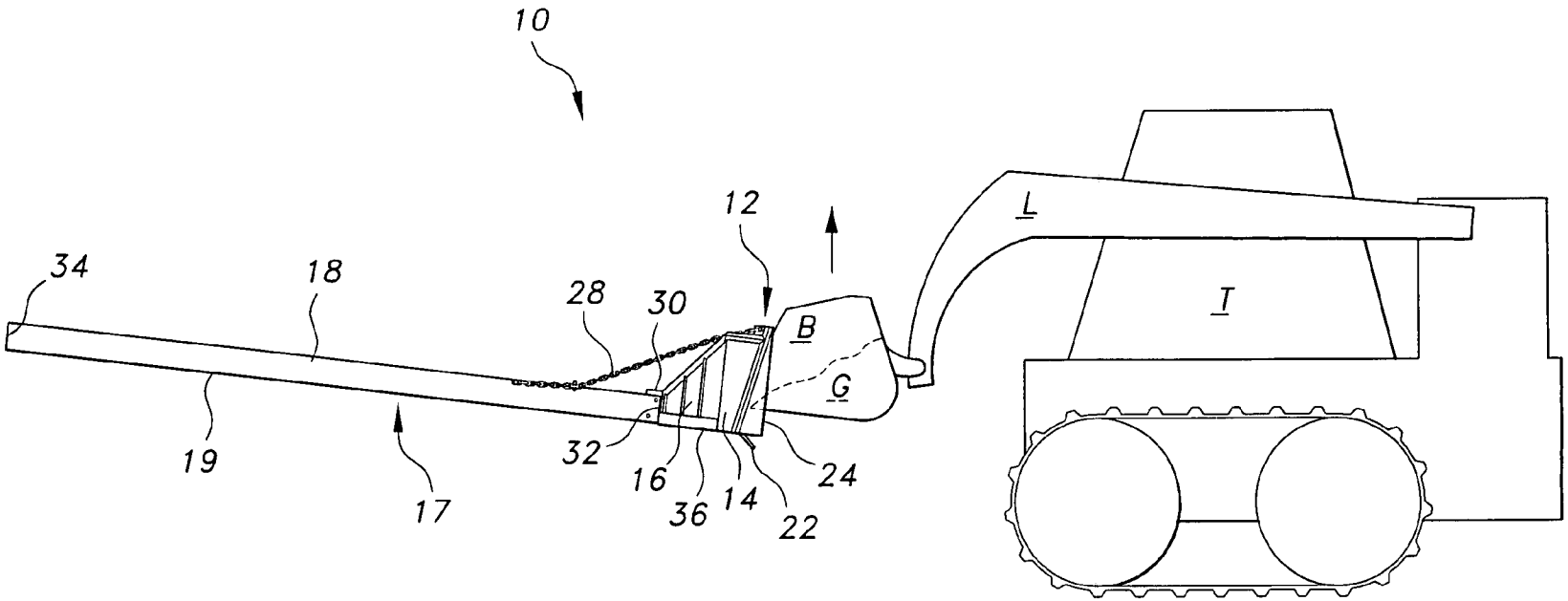
FIG. 3 is a side elevation view similar to that of FIG. 2 with the funnel and distributor engaged with and lifted by the gravel-filled bucket for transport to a building site.

Referring to FIGS. 2 and 3, FIG. 2 is a side elevation view of the system 10 where the bucket B is loaded with gravel G and is in a position to be inserted through opening 24 into funnel 12 by driving tractor T forward until bucket B engages funnel 12. FIG. 3 is a similar side elevation view where the bucket B loaded with gravel G is engaged with funnel 12 and the funnel 12 and delivery chute 17 are raised for transport to a building site. Also shown are support chains 28 extending from the upper portion of funnel 12 and attached to chute sidewalls 18 as separated by chute floor 19 to provide added support to the chute 17.

Figure 4:
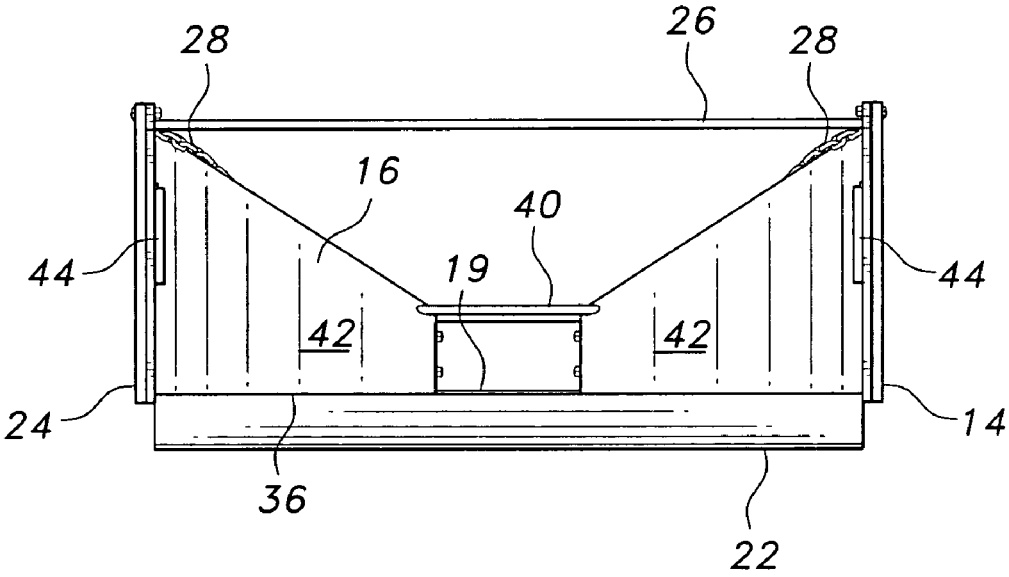
FIG. 4 is a rear elevation view of the funnel and distributor of FIG. 1.

Referring to FIG. 4, there is shown a rear elevation view of the funnel and chute system of FIG. 1 in a grounded position as in FIG. 2, showing the bucket engaging portion 14 defining opening 24 as supported by ground support 22 which is a lip extending downward from funnel floor 36. Funnel 12 has a converging portion 16 having sidewalls 42 extending from bucket engaging portion 14 and converging to the chute 17 (see FIG. 2) having floor 19. Funnel outlet end 25 (see FIG. 5) has an upper wall stiffener rod 40 extending therebetween for added rigidity. Hook receiving bar 26 extends across the opening 24, also providing stiffening and rigidity to the funnel structure. Bucket guides 44 are metal bars mounted at an inclined angle on the respective inner walls of bucket engaging portion 14 to guide bucket B to the appropriate position to engage funnel hook receiving bar 26 with hooks 20 so as to engage the funnel 12 for use. Guides 44 are angled to match the angle of the front portion of bucket B and extend toward and are spaced from respective hooks 20.

Figure 5:
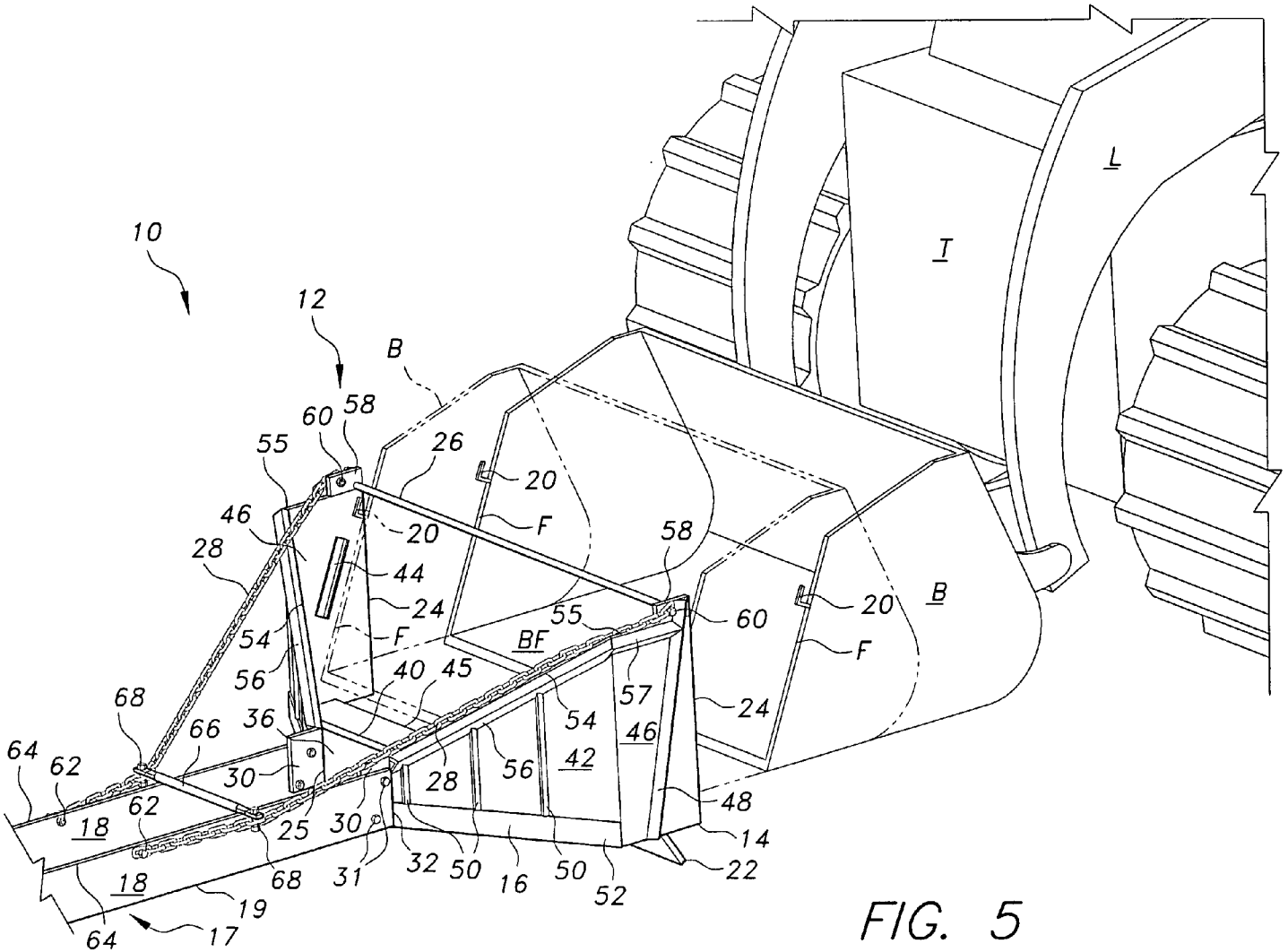
FIG. 5 is an environmental perspective view of the funnel and distributor illustrating its engagement with the front loader bucket.

Referring to FIG. 5, there is shown an environmental perspective view of the inventive front end loader bucket discharge and distributing system 10 wherein tractor T is shown in a position to move forward to engage funnel 12 with the bucket B. Bucket B is also shown in ghost lines in a position to engage the bucket engaging portion 14 of funnel 12 by raising the bucket B upward. As is seen the bucket side hooks 20 of bucket front sidewall edges F (shown in ghost lines) are in a position to engage hook receiving bar 26, and the sidewall edges F are in a position to engage bucket guides 44 upon lifting bucket B. When the funnel and chute system 10 is raised as in FIG. 3 or lowered as in FIG. 1, hooks 20 engage hook receiving bar 26 and the system 10 is supported by bucket front sidewall edges F bearing against bucket guides 44. Also, the bucket floor BF (ghost lines) extends above bucket engaging portion floor rear edge 45 such that during the dumping operation (see FIG. 1) the contents of bucket B flow from bucket floor BF onto funnel floor 36 and onto chute floor 19 during the material delivery operation (see FIG. 1).

Engaging portion sidewall stiffeners 48 (shown as angle stock) are welded at an upward, rearward slope along bucket engaging portion sidewalls 46. Funnel sidewall portion stiffeners 52 (shown as angle stock) are spaced vertically along sidewalls 42 extending between generally horizontally disposed lower funnel portion stiffeners 50 and forward and downward sloping converging portion sidewall upper stiffeners 56 (shown as angle stock) forming the upper edges 54 of funnel portion sidewalls 42. Stiffeners 50 also provide for attachment between sidewalls 42 and floor 36. The generally horizontal upper edges 55 of bucket engaging portion sidewalls 46 are formed by stiffeners 57 extending between the respective rear ends of stiffeners 56 and angled sidewall stiffener 48.

Angled sidewall stiffeners 48 extend upward beyond upper edges 55 at the bucket engaging opening 24 and serve as mounts for upper mounting plates 58. Upper mounting plates 58 serve as end mounts for hook receiving bar 26. Also, the upper ends of chute support chains 28 are mounted by means of upper chain fasteners 60 (shown as nuts and bolts) to upper mounting plates 58.

Funnel portion walls 42 converge inward from bucket engaging portion sidewalls 46 to centrally disposed funnel outlet end 25, while funnel portion upper edges 54 angle downward and forward along between bucket engaging portion upper edges 55 and the upper ends of chute attachment plates 30. Chute attachment plates 30 are attached at funnel outlet end 25 to the ends of respective sidewall stiffeners 50 and 56 and the vertical ends of walls 42.

Lower chain fasteners 62 (shown as nuts and bolts) attach the lower ends of chute support chains 28 to chute walls 18 near their respective upper edges 64. A chain cross bar 66 is attached perpendicular to and across chute upper edges 64 and extending outside chute walls 18 having chain fasteners 68 (nuts and bolts) extending through respective chain links, thereby pulling chains 58 inward toward chute walls 68.

In operation, the bucket B of the front end loader truck T is loaded with disperse material such as gravel G from a storage pile. The end loader is then driven and maneuvered to engage the inventive funnel and chute system 10 at its rear end. The engaging portion 14 of the funnel 12 has a guide 44 on each inner side of wall 46 to guide the bucket B to the proper engaging position as the bucket moves into the engaging portion 14 of the funnel 12. The bucket becomes fully engaged once the engaging hooks 20 on the bucket sidewall edges F pass under and engage the engaging bar 26.

The now fully engaged funnel and distributing chute system 10 is lifted from the ground and become an extension of the bucket B. During lifting and lowering, hooks 20 engage hook receiving bar 26 and guides 44 bear the weight of the system against bucket sidewall edges F. Support chains 28 extend from the chain mount plates 58 at the upper rear end of the funnel 12 to points on the chute 17 and fasted by lower chain fasteners 62 for mechanical support of the chute. The front end loader in the raised position is then maneuvered into a position such that the chute opens over the desired location for the bucket contents to be discharged such as at a desired location on the gravel floor base F for a basement floor cement pour. The bucket B is then lowered over the side of the basement wall, allowing gravel G in the bucket to move by gravity onto the funnel floor 36 and into the converging portion 16 of the funnel, down the now inclined chute 17, and out to the desired delivery location. The gravel or other disperse material may then be easily spread by rakes at the desired location without the use of transporting wheelbarrows.

Upon emptying its load, the front loader truck T maneuvers away from the delivery site, grounds the funnel and chute 10, and upon full lowering of the bucket B and backing away, disengages from the inventive funnel and chute system 10 and proceeds to fill the bucket from the storage pile. This procedure is repeated until the basement floor base F is completed and ready for concrete pour.

It is to be understood that the present invention is not limited to the embodiment described above, but encompasses any and all embodiments within the scope of the following claims.

I claim:

1. A front end loader bucket discharge funnel and distributor chute comprising:

a funnel having a bucket receiving portion and a converging portion;

said bucket receiving portion defining an opening for receiving the front portion of a front end loader bucket;

said bucket receiving portion having bucket engaging guides and a hook engaging bar;

funnel engaging hooks mountable on the front portion of the front end loader bucket for engaging said hook engaging bar;

said bucket engaging guides engaging the front end loader bucket when said funnel engaging hooks engage said hook engaging bar;

said converging portion of said funnel having an outlet end defining an outlet opening substantially smaller than said opening defined by said bucket receiving portion; and a delivery chute attached to and extending from said funnel outlet end;

said delivery chute being aligned with said funnel outlet opening so as to receive disperse material from said bucket via said funnel;

whereby, upon said front loader bucket mounted on a tractor being filled with disperse material, the front portion of the bucket may be inserted into said bucket receiving portion of said funnel by driving the tractor forward until the bucket engages said guides, the bucket raised by the tractor until said engaging hooks engage said hook engaging bar, thereby engaging the funnel and delivery chute, the bucket then raised along with the funnel and delivery chute, the tractor driven to a delivery site, and the funnel and chute lowered over a wall the disperse material being delivered by gravity to a location below the wall by traveling from the bucket, through the funnel, and then through the chute to a desired point at the outlet of the chute.

2. The funnel and distributor chute of claim 1, wherein said bucket receiving portion and said converging portion have respective sidewalls and a common floor.

3. The funnel and distributor chute of claim 2, wherein said opening defined by said bucket receiving portion is defined by said sidewalls, said floor and said hook engaging bar.

4. The funnel and distributor chute of claim 2, wherein said bucket guides are disposed at an angle along respective inner sides of said bucket receiving portion of said funnel, said angle approximating the angle of the front portion of the bucket, said bucket guides being generally aligned with said hook engaging bar and spaced therefrom.

5. The funnel and distributor chute of claim 2, further comprising upper mounting plates extending upward from said bucket receiving portion sidewalls at said respective bucket receiving opening; said hook engaging bar being mounted between said respective mounting plates.

6. The funnel and distributor chute of claim 2, wherein said bucket receiving portion sidewalls have generally horizontal upper edges parallel with said floor and said converging portion sidewalls have upper edges sloping downward from said upper edges of said bucket receiving portion to the upper end of said funnel outlet end.

7. The funnel and distributor chute of claim 2, further comprising chute attachment plates extending outward from said sidewalls at the funnel outlet.

8. The funnel and distributor chute of claim 7, said chute having an inlet end, an outlet end, a floor, and opposing sidewalls, said funnel being mounted at said inlet end to said attachment plates such that said inlet end is aligned with said funnel outlet.

9. The funnel and distributor chute of claim 2, wherein said funnel floor has a rear edge inset relative to said bucket receiving portion sidewalls.

10. The funnel and distributor chute of claim 9, further comprising a lip extending downward from said rear edge.

11. The funnel and distributor chute of claim 5, further comprising support chains attached at their upper end to respective said upper mounting plates and at their lower ends to respective sidewalls of said chute at mounting points about equally spaced from said funnel outlet opening.

12. The funnel and distributor chute of claim 11, further comprising a cross bar extending across said chute at a point between said mounting points and said funnel outlet opening, said cross bar having chain mounts at each end thereof and proximate the outer sides of said cute sidewalls for engaging respective chain links.

13. A front end loader bucket discharge funnel and distributor chute comprising:

a funnel having a bucket receiving portion and a converging portion;

said bucket receiving portion defining an opening for receiving the front portion of a front end loader bucket;

said bucket receiving portion having bucket engaging guides and a hook engaging bar;

funnel engaging hooks mountable on the front portion of the front end loader bucket for engaging said hook engaging bar;

said bucket engaging guides engaging the front end loader bucket when said funnel engaging hooks engage said hook engaging bar;

said converging portion of said funnel having an outlet end defining an outlet opening substantially smaller than said opening defined by said bucket receiving portion;

a delivery chute attached to and extending from said funnel outlet end;

said delivery chute being aligned with said funnel outlet opening so as to receive disperse material from said bucket via said funnel;

said bucket receiving portion and said converging portion having respective sidewalls and a common floor;

said bucket receiving opening being defined by said sidewalls, said floor and said hook engaging bar;

said bucket guides being disposed at an angle along respective inner sides of said bucket receiving portion of said funnel, said angle approximating the angle of the front portion of the bucket, said bucket guides being generally aligned with said hook engaging bar and spaced therefrom.

14. The funnel and distributor chute of claim 13, further comprising upper mounting plates extending upward from said bucket receiving portion sidewalls at said respective bucket receiving opening; said hook engaging bar being mounted between said respective mounting plates.

15. The funnel and distributor chute of claim 14, wherein said bucket receiving portion sidewalls have generally horizontal upper edges parallel with said floor and said converging portion sidewalls have upper edges sloping downward from said upper edges of said bucket receiving portion to the upper end of said funnel outlet end.

16. The funnel and distributor chute of claim 15, further comprising chute attachment plates extending outward from said sidewalls at the funnel outlet.

17. The funnel and distributor chute of claim 16, said chute having an inlet end, an outlet end, a floor, and opposing sidewalls, said funnel being mounted at said inlet end to said attachment plates such that said inlet end is aligned with said funnel outlet.

18. The funnel and distributor chute of claim 17, further comprising support chains attached at their upper end to respective said upper mounting plates and at their lower ends to respective sidewalls of said chute at mounting points about equally spaced from said funnel outlet opening.

19. The funnel and distributor chute of claim 18, further comprising a cross bar extending across said chute at a point between said mounting points and said funnel outlet opening, said cross bar having chain mounts at each end thereof and proximate the outer sides of said cute sidewalls for engaging respective chain links.

* * * * *